US005819707A

United States Patent [19]

Grytz et al.

[11] Patent Number: 5,819,707

[45] Date of Patent: Oct. 13, 1998

[54] FUEL INJECTION VALVE

[75] Inventors: Uwe Grytz, Bamberg; Stefan Lauter, Lautertal, both of Germany

[73] Assignee: Robert Bosch GmbH, Stuttgart, Germany

[21] Appl. No.: 836,709

[22] PCT Filed: Jul. 18, 1996

[86] PCT No.: PCT/DE96/01302

§ 371 Date: May 19, 1997

§ 102(e) Date: May 19, 1997

[87] PCT Pub. No.: WO97/11270

PCT Pub. Date: Mar. 27, 1997

[30] Foreign Application Priority Data

Sep. 21, 1995 [DE] Germany ..... 195 35 047.2

[51] Int. Cl.[6] ..... F02B 15/00

[52] U.S. Cl. ..... 123/432; 123/531; 239/533.12

[58] Field of Search ..... 123/531, 432, 123/585; 239/533.12, 533.13

[56] References Cited

U.S. PATENT DOCUMENTS

| | | | |
|---|---|---|---|
| 5,244,154 | 9/1993 | Bucholz et al. | 239/533.12 |
| 5,520,157 | 5/1996 | Pontoppidan | 123/531 |
| 5,603,301 | 2/1997 | Sakurai et al. | 123/585 |
| 5,636,613 | 6/1997 | Aoyama et al. | 123/432 |

FOREIGN PATENT DOCUMENTS

| | | |
|---|---|---|
| 1167458 | 3/1989 | Japan . |
| 4005469 | 9/1992 | Japan . |
| 6081755 | 3/1994 | Japan . |

*Primary Examiner*—Erick R. Solis
*Attorney, Agent, or Firm*—Edwin E. Greigg; Ronald E. Greigg

[57] ABSTRACT

A fuel injection valve comprising a front attachment in whose wall a blocking element is displaceably supported; on its slide segment toward an air chamber, the pressure in the inlet tube upstream of a throttle valve prevails, while in the opposite direction the intake tube pressure downstream of the throttle valve is operative. If there is a sufficient pressure difference, the blocking element is displaced to the left far enough that it blocks at least one injection port on the fuel injection valve and blocks one guide conduit in the front attachment. As a result, only the one open inlet valve of one cylinder of the engine is supplied with fuel, via the at least one open injection port and the open guide conduit. The fuel injection valve is especially suitable for fuel injection in mixture-compressing internal combustion engines with externally supplied ignition.

12 Claims, 8 Drawing Sheets

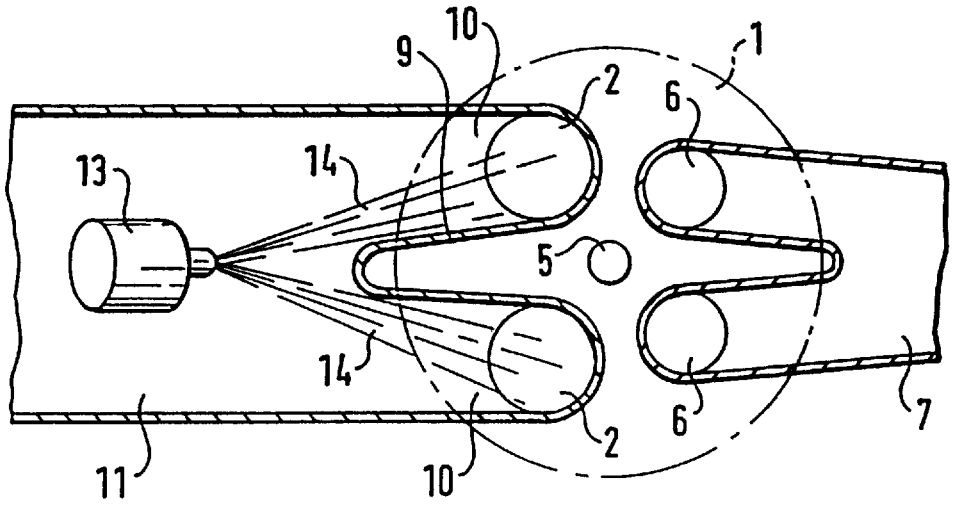
FIG. 1b
FIG. 2a
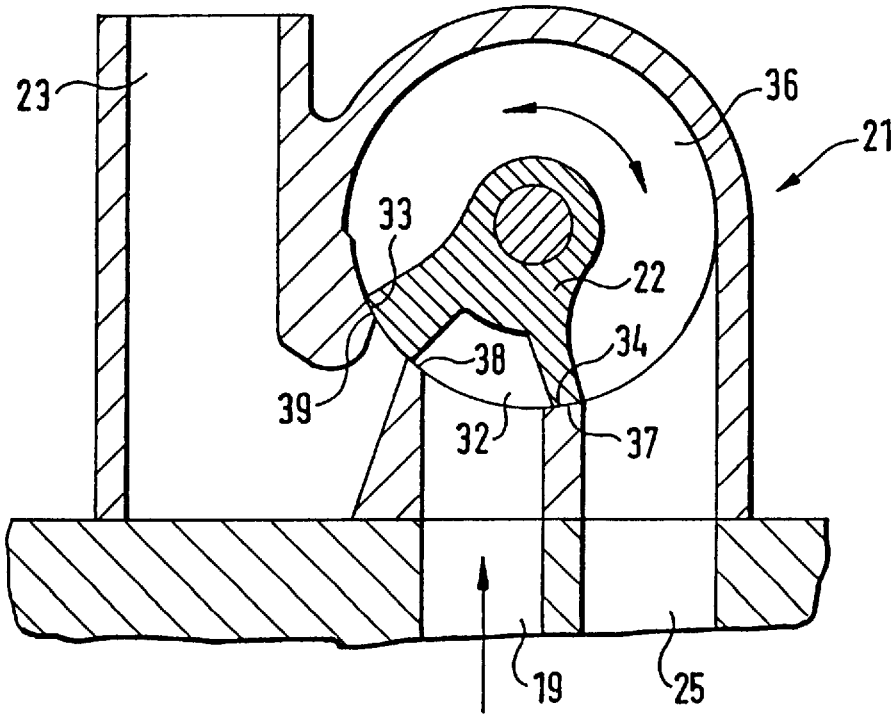

FUEL INJECTION VALVE

PRIOR ART

The invention is based on a fuel injection valve. A fuel injection valve is already known (U.S. Pat. No. 4,982,716) in which the fuel streams, aimed at the various inlet conduits of a cylinder, are always ejected simultaneously. This has the disadvantage however, that whenever in certain operating states of the internal combustion engine, such as idling and lower partial load, one of the at least two inlet valves is turned off to improve engine operation with respect to fuel consumption and exhaust emissions, at least one of the separate fuel streams undesirably hits the closed inlet valve.

Two separate fuel streams are generated in this fuel injection valve, because downstream of the valve seat a single fuel stream strikes an impact face and is split into two separate fuel streams by a stream splitter.

From European Patent EP 0 242 978, a fuel injection valve is also known that has a perforated disk, downstream of the valve seat face, in which six injection ports are provided; the individual streams each emerging from three injection ports are aimed toward one another in such a way that two separate fuel streams are produced, and each fuel stream is aimed into one inlet conduit of a cylinder of the engine. In this fuel injection valve as well, the fuel is injected into the two inlet conduits of each engine cylinder via the two separate fuel streams even if one of the inlet valves is closed.

A fuel injection valve is also known (SAE Technical Paper Series 920 294, 1992; Development of Air-Assisted Injector System), in which an adapter with a stream splitter is provided, by means of which fuel injected from the injection valve is split into two fuel streams, to which air for preparation is added via air conduits; the air is controllable by a control valve that branches off from a bypass line around the throttle valve in the engine intake tube. With one closing member, the control valve opens and closes the air line to the fuel injection valves, and with another closing member it closes the bypass line around the throttle valve.

ADVANTAGES OF THE INVENTION

The fuel injection valve according to the invention has the advantage over the prior art that in a simple way, in certain engine operating states such as idling and lower partial load, fuel is delivered to each cylinder of the engine only via the open inlet valve or valves, while in the these certain operating states, no fuel is prestored upstream of the closed inlet valves or valve. As a result, not only fuel consumption but also the proportion of pollutants in the exhaust gas can be reduced, and the performance at transitions between operating states can be improved.

By means of the provisions recited herein, advantageous further features of and improvements to the fuel injection valve disclosed hereinafter are possible.

It is especially advantageous to dispose a front attachment, in which the blocking element is supported movably, on the fuel injection valve. Hence there is no need to modify the construction of existing fuel injection valves; a suitable front attachment need merely be adapted to the particular fuel injection valve. It is also advantageous to displace the blocking element by means of air that is delivered to the fuel injection valve to prepare the injected fuel. It is also advantageous to insert a control valve into the air line to the blocking element, by which valve the air line can be closed partway or entirely, in order to actuate the blocking element exactly in accordance with particular requirements of the engine.

BRIEF DESCRIPTION OF THE DRAWINGS

Exemplary embodiments of the invention are shown in simplified form in the drawings and described in further detail in the ensuing description.

FIG. 1*b* is a schematic illustration of the injection of two separate fuel streams through one fuel injection valve into two inlet conduits of a cylinder of an internal combustion engine;

FIGS. 2*a*–2*c* show a control valve in various switching positions;

DESCRIPTION OF THE EXEMPLARY EMBODIMENTS

Figure 1A:
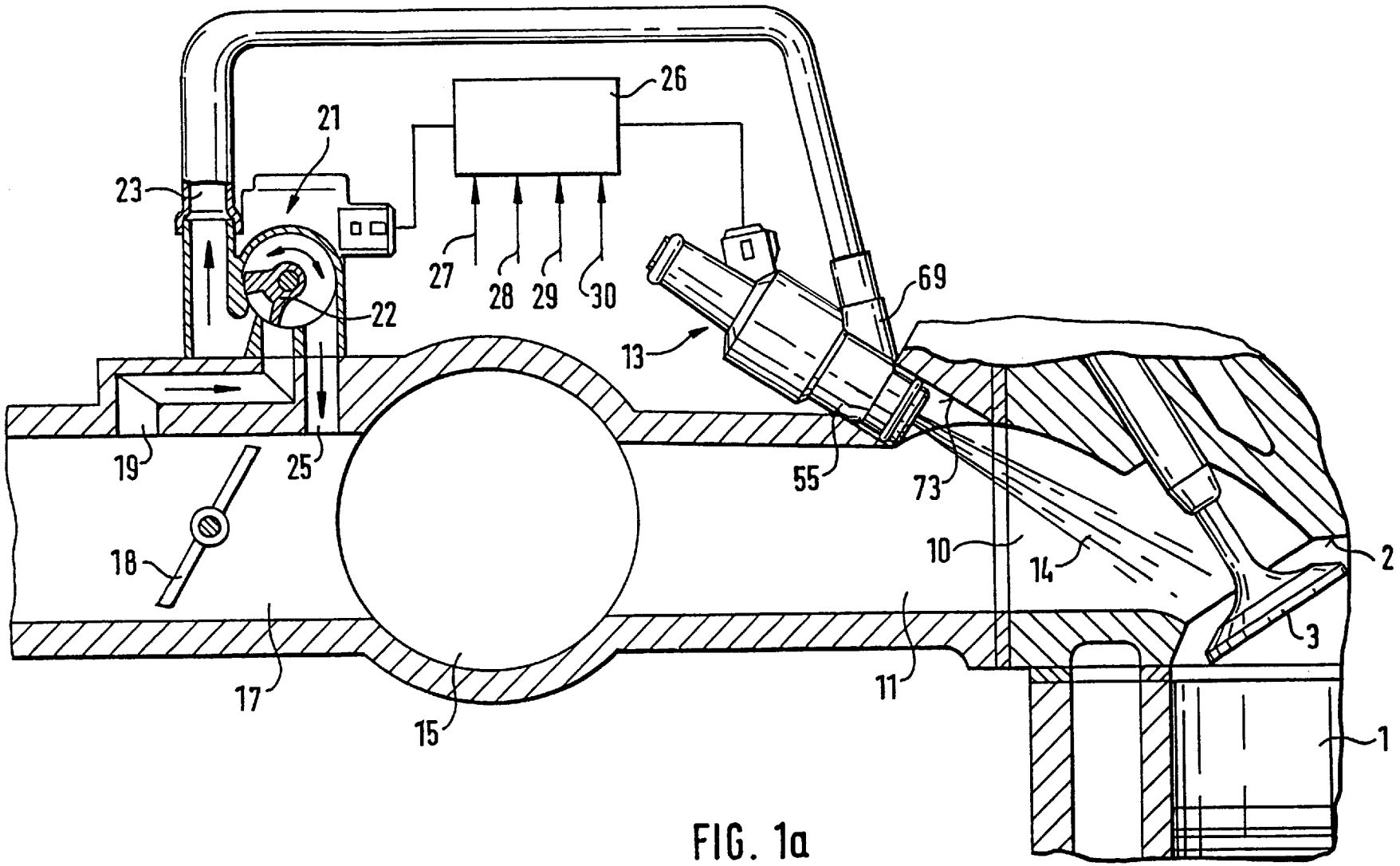
FIG. 1*a* shows a fuel injection valve, disposed at an inlet conduit of an internal combustion engine, to which an air line with a control valve is connected.

In FIG. 1*a*, a cylinder of a mixture-compressing internal combustion engine with externally supplied ignition is shown; it has at least one inlet opening 2, which is opened or closed by an inlet valve 3. To improve the efficiency and reduce the exhaust gas components of the engine, especially by lean operation and charge stratification, the cylinders of the engine are today often provided with two or more inlet valves and outlet valves. FIG. 1*b* shows a cylinder with two inlet openings 2, in which for the sake of simpler illustration the inlet valves 3 have been left out. A spark plug 5 serves to ignite the fuel-air mixture compressed in the cylinder 1, and two outlet openings 6, which are controlled by outlet valves not shown, lead to the exhaust line 7 of the engine. Separated by a partition 9, one inlet conduit 10 leads to each inlet opening 2; the two inlet conduits 10 unite upstream of the partition 9 to form one single intake tube 11 associated with the respective cylinder. Protruding partway into the individual intake tube 11 is an injection end of a fuel injection valve 13, which injects two separate fuel streams 14; one fuel stream 14 is aimed in the direction of one inlet conduit 10 or one inlet opening 2. As described in conjunction with FIG. 1*b*, in FIG. 1*a* as well the cylinder 1 has two inlet valves 3 and two inlet openings 2, which are supplied with fuel through a single fuel injection valve 13. In another embodiment, however, it is also possible for the cylinder 1 to have only a single inlet valve 3 and a single inlet opening 2, while the fuel injection valve 13 is still embodied such that it injects at least two separate fuel streams in the direction of the inlet conduit 10 or inlet opening 2. The orientation of the separate fuel streams 14 can be selected very accurately and adapted to a favorable operating performance of the engine.

The single inlet tube 11 originates at a distributor 15, from which the single intake tubes to the other engine cylinders, not shown, also branch off. Upstream of the distributor is the intake tube 17 with the throttle valve 18, which is actuatable by the vehicle driver by means of an accelerator pedal, not shown. Upstream of the throttle valve 18, an air bypass 19 branches off from the intake tube 17; a control valve 21 is disposed in the air bypass, and its control body 22 can assume various positions continuously in order to close the air bypass 17, make a connection from the air bypass to an air line 23 leading to the fuel injection valve 13, and then also make a connection from the air bypass 19 to an inflow line 25, leading downstream of the throttle valve 18 to the intake tube 17, and finally to block off the communication with the air line 23 completely and keep only the communication with the inflow line 25 open. By way of example, the control valve 21 is actuated by an electric motor and triggered by an electronic control unit 26 via electric lines. The triggering of the electromagnetically actuatable fuel injection valve 13 is also effected by the electronic control unit 26 via electric lines. Measured values of engine operating parameters, such as the rpm 27, the load 28 in accordance with the rotational angle of the throttle valve 18, the engine temperature 29, the oxygen concentration 30 in the exhaust line 7, and others, are supplied to the electronic control unit after having been converted into electrical signals.

Figure 2B:
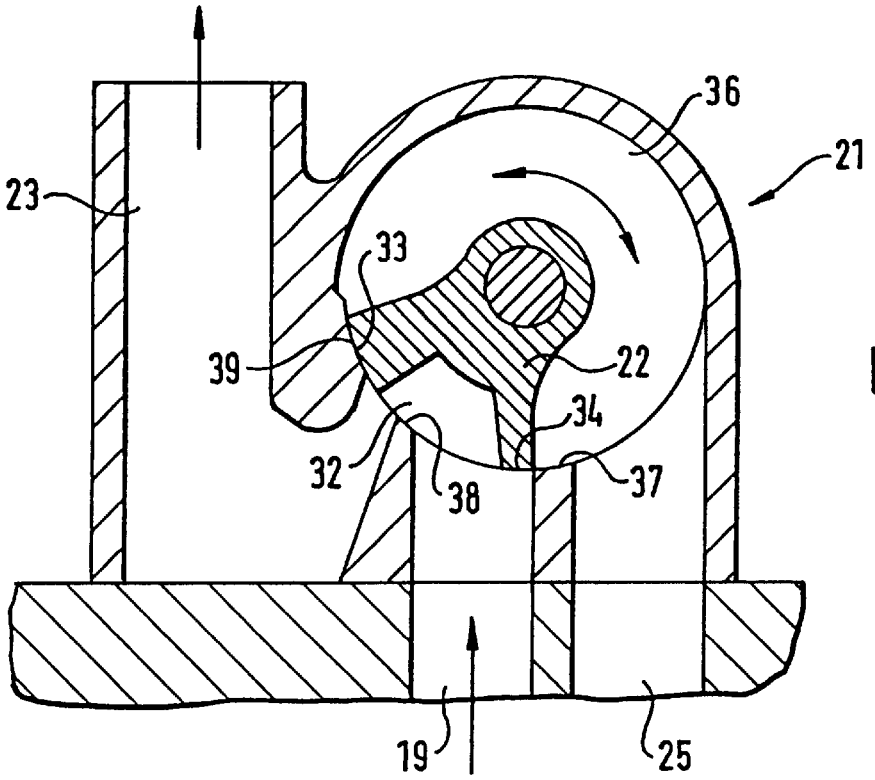
Figure 2C:
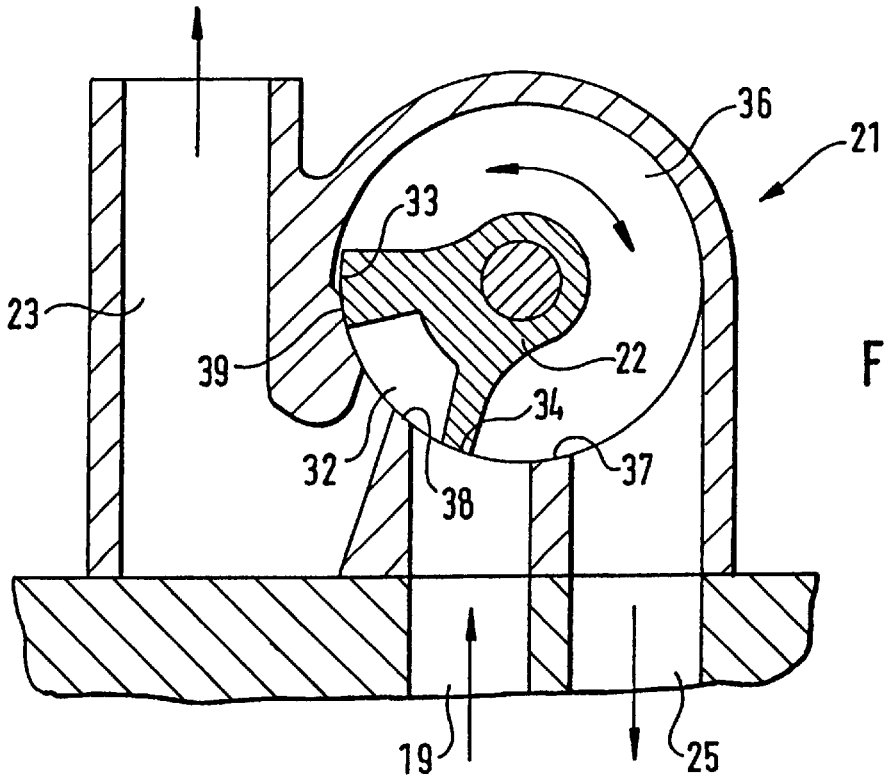

In FIGS. 2*a*, 2*b* and 2*c*, the control valve 21 of FIG. 1*a*, embodied as a rotary slide and for instance driven by an electric motor, is shown in simplified form once again in various control positions; the reference numerals chosen for FIG. 1*a* have been retained. The control body 22 embodied as a rotary slide is rotatable by an electric motor, not shown, and in cross section takes the form of a segment of a circle with an indentation 32, which is bounded by a first sealing lip 33 and a second sealing lip 34 of the control body 22. Upon a clockwise rotary motion of the control body 22, the first sealing lip 33 is ahead and the second sealing lip 34 trails behind. The control body 22 is rotatably supported in a work chamber 36 with which the air bypass 19, the air line 23, and the inflow line 25 communicate. The air bypass 19, at its mouth into the work chamber 36, is bounded by a first sealing face 37 and, following it in the clockwise direction, a second sealing face 38. The second sealing face 38 at the same time defines the mouth of the air line 23 into the work chamber 36, which is bounded in the clockwise direction by a third sealing face 39. In FIG. 2*a*, the control body 22 assumes a position in which the first sealing lip 33 partly covers the second sealing face 38 and the third sealing face 39, and the second sealing lip 34 partly covers the first sealing face 37, so that the communication from the air bypass 19 to the air line 23 and to the inflow line 25 is interrupted. If the control body 22, in idling and lower partial-load operation of the engine, is now rotated clockwise, then the second sealing lip 34 initially continues to cover the first sealing face 37, while the first sealing lip 33 moves away from the second sealing face 38 and thus, via the indentation 32, opens up a communication from the air bypass 19 to the air line 23. FIG. 2*b* shows a position of the control body 22 in which a flow communication from the air bypass 17 to the air line 23 is opened by the control body 22, yet the second sealing lip 34 still just covers the first sealing face 37 enough that there is no flow of air from the air bypass 19 to the inflow line 25. If the control body 22 is rotated clockwise beyond the position shown in FIG. 2*b*, then the second sealing lip 34 moves away from the first sealing face 37, so that now, in addition to the flow from the air bypass 19 to the air line 23, the flow path from the air bypass 19 to the inflow line 25 is also opened. Such a position of the control body 22 is shown in FIG. 2*c*. To assure, in the event of an error in the electronic control unit or in the electric lines or electric motor, that the engine will continue to be operated in a so-called emergency mode, it may be expedient, by means of a restoring spring, not shown, and beginning at a position in accordance with FIG. 2*a*, to rotate the control body 22 counterclockwise far enough that either the first sealing lip 33 moves out of contact with the third sealing face 39, or the second sealing lip 34 moves out of contact with the first sealing face 37, or both the first sealing lip 33 moves out of contact with the third sealing face 39 and the second sealing lip 34 also moves out of contact with the first sealing face 37, so that a hydraulic communication is established either from the air bypass 19 to the air line 23 or to the inflow line 25, or from the air bypass to both of these lines.

Figure 3:
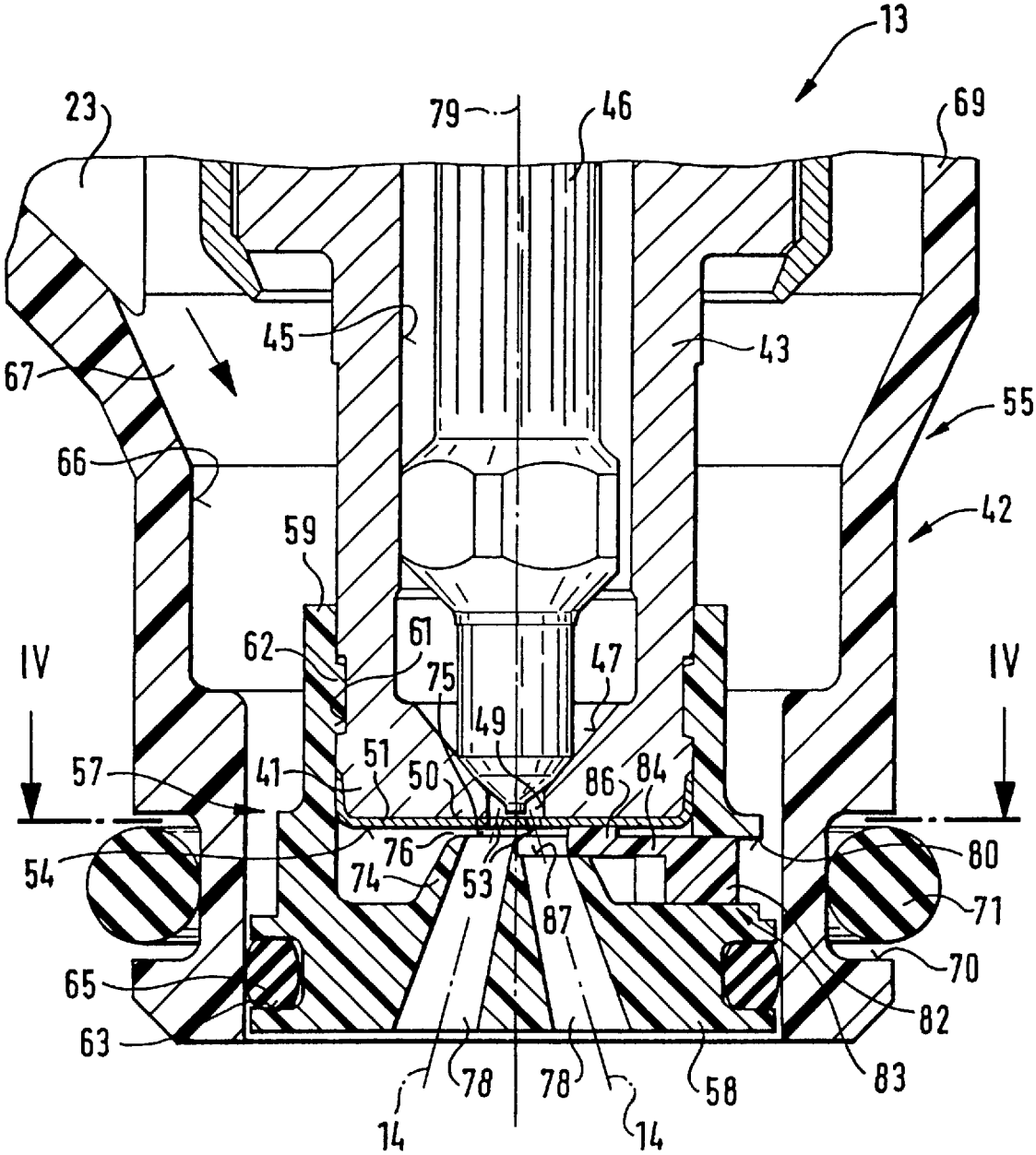
FIG. 3 shows a first exemplary embodiment of a fuel injection valve embodied according to the invention, with a blocking element in the nonblocking position.

In FIG. 3, an example of an otherwise already known fuel injection valve 13 for fuel injection systems of mixture-compressing internal combustion engines with externally supplied ignition is shown in part; on its injection end 41, it has a front attachment 42, made for instance of plastic. The injection end 41 of the fuel injection valve 13 is embodied in a nozzle body 43 that is provided with a longitudinally extending guide conduit 45 in which a movable valve closing member 46, such as a valve needle, is slidably supported. Remote from the injection end 41, the guide conduit 45 changes over into a valve seat face 47, with which the valve closing member 46 cooperates. In the flow direction, the valve seat face 47 changes over into an outflow opening 49, which extends as far as a nozzle body end face 50. In the exemplary embodiment shown, an injection port disk 51 rests on the nozzle body end face 50 and is tightly connected to it, for instance by an encompassing sealing seam radially spaced apart from the outflow opening 49. Where the outflow opening 49, in the exemplary embodiment of FIG. 3, is covered, there are for instance at least two injection ports 53 in the injection port disk 51; they extend as far as a lower end face 54 of the injection port disk 51. It is not a requirement that there be at least two injection ports 53 in the injection port disk 51. In a manner not shown, it is also possible for there to be only one injection port 53 in the injection port disk 51; then the fuel emerging from the one injection port is divided downstream into two individual streams by a stream splitter, as is already known from the known fuel injection valves described in the introduction to this specification. Nor is the injection port disk 51 a requirement; it is also possible to use a fuel injection valve in which there is no injection port disk, but instead in which the fuel is injected via the outflow opening 49 or at least two injection ports adjoining the outflow opening 49 and embodied on the nozzle body end face 50. The actuation of the fuel injection valve is effected in a known manner, such as electromagnetically. For axially moving the valve closing member 46 and hence for opening the fuel injection valve counter to the spring force of a restoring spring not shown, or closing the fuel injection valve, an electromagnetic circuit is used, which has a magnet coil, armature and core, not shown. The armature is connected to the end of the valve closing member 46 remote from the valve seat face 47 and is oriented toward the core.

Figure 4:
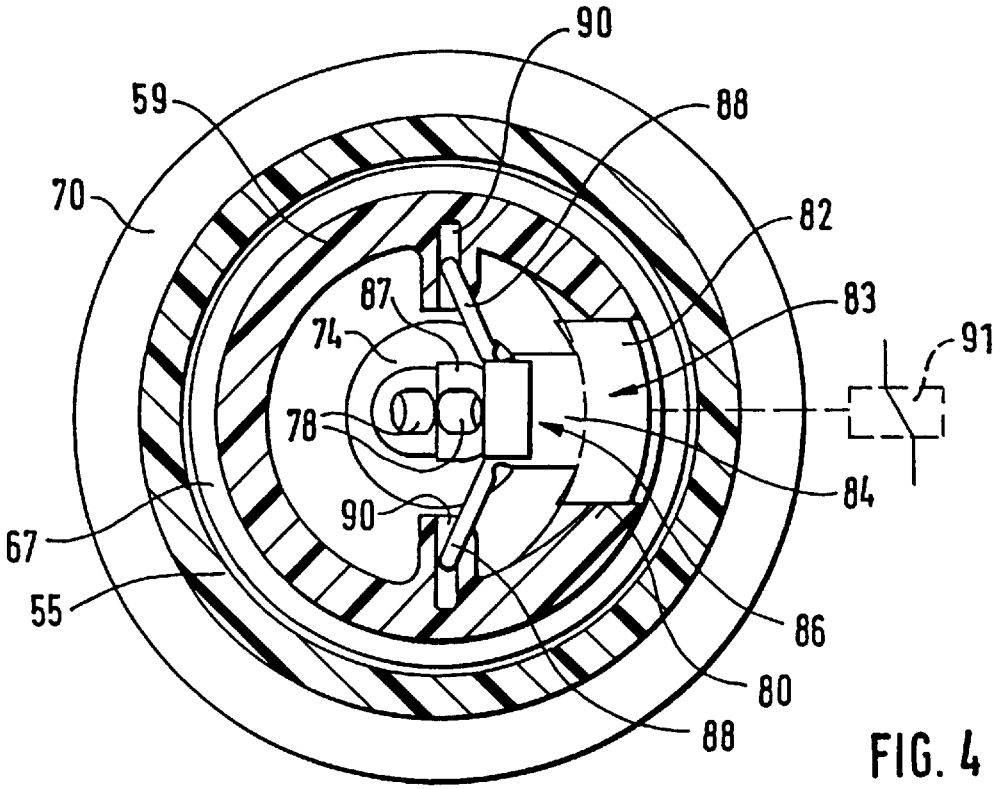
FIG. 4 is a section taken along the line IV—IV of FIG. 3.

The front attachment 42 for instance comprises a stepped tubular air guide body 55 and an injection body 57. The injection body 57 is cup-shaped, with a bottom 58 that is adjoined by an annular rim 59 surrounding the injection end 41 of the fuel injection valve 13. An encompassing detent groove 61 is formed on the injection end 41 of the fuel injection valve 13; a detent protrusion extending at least partway around engages this groove and thus fixes the injection body 57 to the injection end 41 of the fuel injection valve. An elastic sealing ring 65, on which a stepped inner wall 66 of the air guide body 55 rests tightly with radial pressure, is disposed in an annular groove 63 provided on the circumference of the injection body 57. The air guide body 55 extends axially beyond the annular rim 59 and partway beyond the housing, on which it rests in sealed fashion, in a manner not shown. The inner wall 66 of the air guide body 55 is radially spaced apart from the injection body 57 and from the housing of the fuel injection valve, except for the sealed points of the sealing ring 65 and at the periphery of the housing of the fuel injection valve 13, so that between the inner wall 66 and the exterior of both the fuel injection valve and the annular rim 59 an annular air chamber 67 is formed, which communicates with the air line 23 via an air fitting 69. Axially approximately in the region of the bottom 58 of the injection body 57, an annular groove 70 is formed on the circumference of the air guide body 55; in it, an elastic sealing ring 71 is provided, which on insertion of the fuel injection valve 13, with the front attachment 42 disposed on it, into a valve conduit 73 (FIG. 1*a*) of the wall of the single intake tube 11 seals off the intake tube atmosphere from the ambient atmosphere outside. The bottom 58 of the injection body 57 has a dome 74, rising in the direction of the injection port disk 51; between the end face 75 of the dome toward the injection port disk 51 and the lower end face 54 of the injection port disk, a gap 76 is formed. Beginning at the end face 75 of the dome 74, at least two guide conduits 78 extend through the bottom 58 of the injection body 57, extending approximately in alignment with the associated injection ports 53 and inclined such that the distance from a longitudinal valve axis 79 and the distance from one another become greater in the flow direction. In the exemplary embodiment shown, two guide conduits 78 are provided; through each guide conduit, a fuel stream 14 emerging from one of the injection ports 53 is injected as indicated by the dot-dashed lines. However, each fuel stream 14 may be formed by combining two or more individual streams emerging from individual injection ports. It is also possible for at least one third guide conduit 78 to be provided in the injection port 57, in order to form a further fuel stream 14. Crosswise to the longitudinal valve axis 79, a slide conduit 80 penetrates the annular rim 59 of the injection port 57; in this conduit, a sliding segment 82 of a blocking element 83 is supported substantially tightly but displaceably. The blocking element 83 also has a tonguelike land segment 84, which is connected to the rectangular block-shaped slide segment 82 and on which a sealing segment 86 is embodied. A dome groove 87 extends open toward the end face 75, approximately from the longitudinal valve axis 79 to the circumference of the dome 74; this groove is aimed at the land segment 84, and the land segment 84 rests on this groove with its lower face 94 remote from the injection port disk 51, specifically in its nonblocking outset position, such that it does not protrude into the guide conduit 78. In this outset position, the sealing segment 86 embodied remote from the dome groove 87 is also located in a position in which, while it does rest on the lower end face 54 of the injection port 51, nevertheless it does not cover any injection port 53. Connected to the land segment 84, for instance facing one another, are two spring arms 88, which are slidably supported in guide grooves 90 formed in the annular rim, as shown in FIG. 4. The spring arms 88 effect a restoring force, which counteracts a displacement motion of the blocking element from right to left in terms of FIGS. 3 and 4. The displacement motion of the blocking element 83 is effected by the force of air whenever the compressive force on the slide segment 82 of the air located in the air chamber 67 is greater than the sum of the forces of the spring arms 88 and the compressive force of the air that acts on the blocking element 83 in the in interior of the injection port 57 from the single intake tube 11 via the guide conduits 78 and the gap 76. By a suitable selection of the spring force of the spring arms 88, it can now be attained that a displacement of the blocking element 83 to the left into its position that blocks at least one injection port 53 and one guide conduit 78 occurs only whenever the difference in air pressure, in engine idling and lower partial load operation, between the single intake tube 11 and the intake tube 17 upstream of the throttle valve 18 is great enough for a displacement. As shown in FIG. 1*a*, the air chamber 67 communicates with the intake tube 17 upstream of the throttle valve 18 and is thus at virtually atmospheric pressure. If to increase engine performance the throttle valve 18 is rotated more strongly in the opening direction, then the pressure downstream of the throttle valve 18 and thus also in the single intake tubes 11 rises, and as a result the restoring force on the blocking element 83 is increased, and the blocking element is shifted to the right into its outset position, so that the fuel can again be injected unhindered via all the injection ports 83. In order to define an exact transition point from the blocking position of the blocking element 83 to its outset position and hence from the injection of a single fuel stream to the injection of at least one further fuel stream, and vice versa, it is expedient to dispose a control valve in the air line 23. Such a control valve is already shown in FIGS. 1*a* and 2*a*–2*c*. Beginning with the blocking position of FIG. 2*a*, the control valve 21, until it reaches its position shown in FIG. 2*b*, opens the air bypass 19 continuously to the air line 23, and as a result an adequately strong air force prevails at the blocking element 83 in order to displace the blocking element toward the left, into its position that interrupts at least one injection port 83 and thus one fuel stream. If the control valve 21 is rotated onward clockwise, beyond its position shown in FIG. 2*b*, then the air pressure in the inlet conduit 10 rises, and the blocking element 83 is displaced to the right into its opening position. The actuation of the blocking element 83 by air in the manner described represents merely one possibility. In the same way it is possible to dispense with the air actuation described, and to actuate the blocking element 83 directly by means of an electromagnet 91, shown in dashed lines in FIG. 4, that is triggered by the electronic control unit 26. If the blocking element 83 is in its blocking position, then a lengthening of the duration of injection by the fuel injection valve is controlled via the electronic control unit 26.

Figure 6:
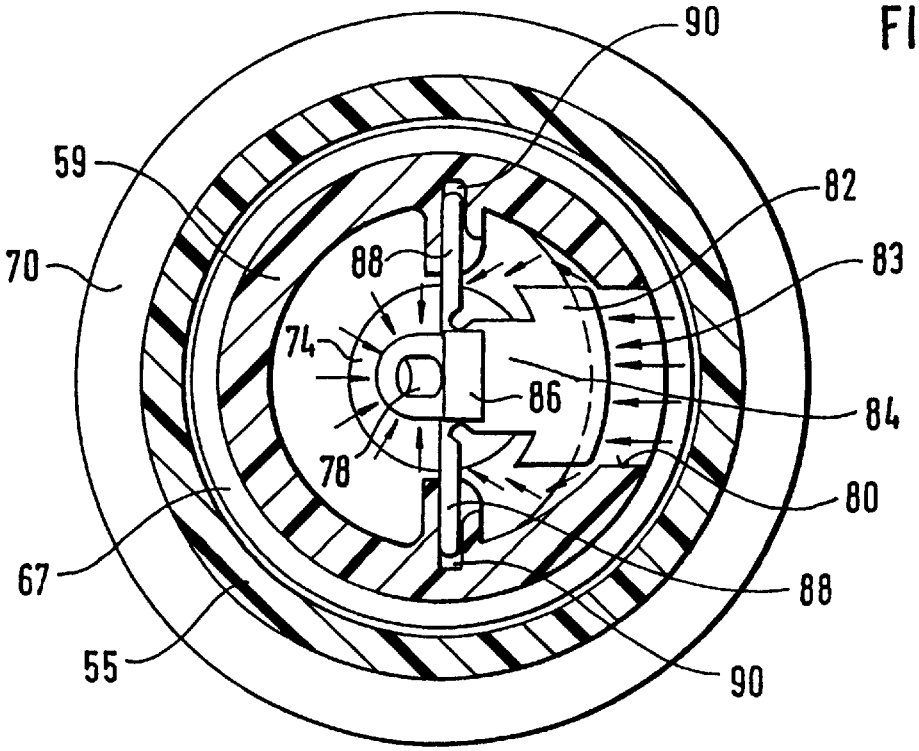
FIG. 6 is a section taken along the line VI—VI of FIG. 5.
Figure 5:
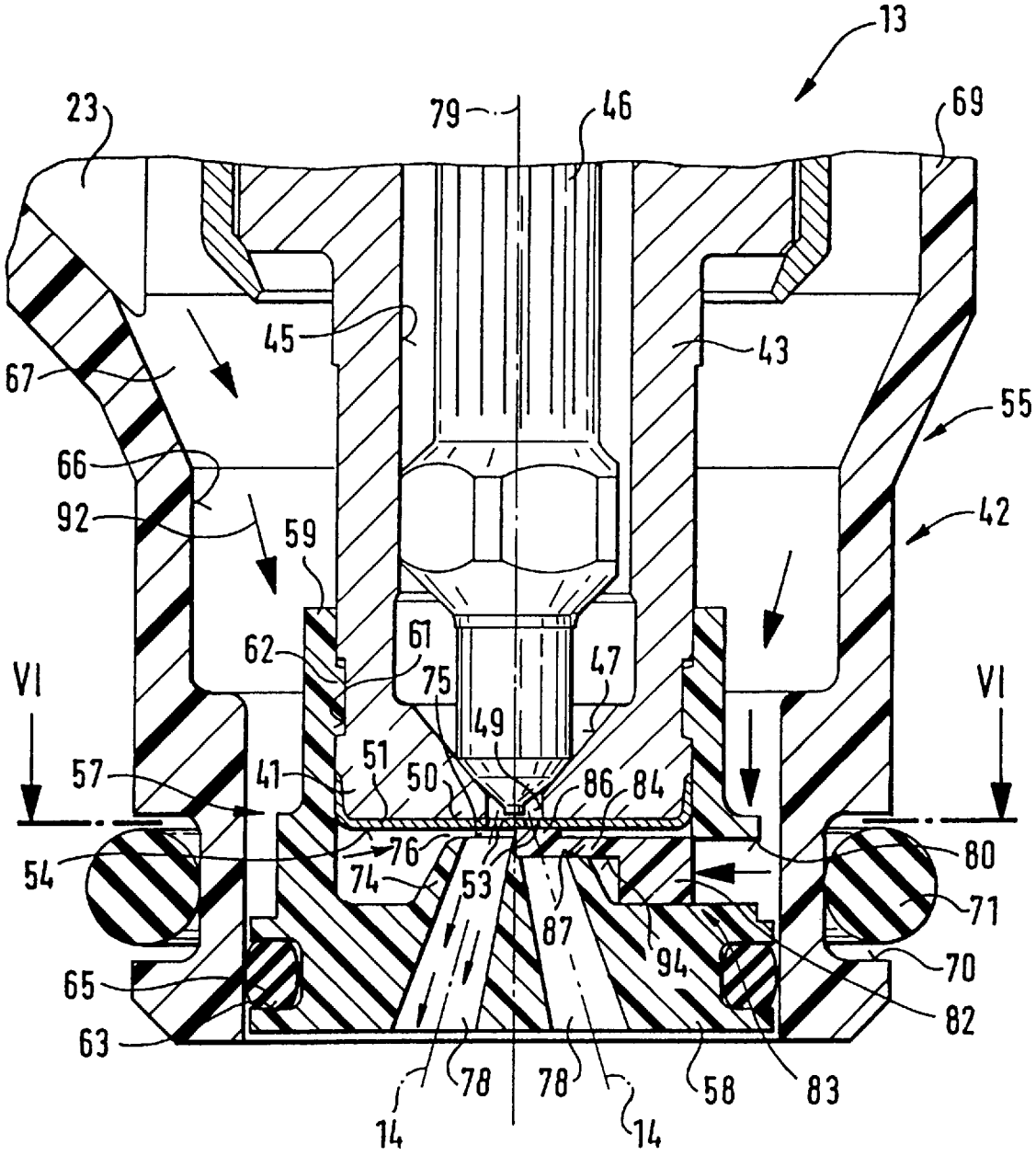
FIG. 5 shows a fuel injection valve of the first exemplary embodiment of FIG. 3, with a blocking element located in the blocking position.

In the ensuing FIGS. 5–8, the same elements and elements functioning the same are identified by the same reference numerals. FIGS. 5 and 6 show the exemplary embodiment of FIGS. 3 and 4, with a blocking element 83 located in the blocking position, that is, its left-hand position, in which it thus blocks at least one injection port 53 and one guide conduit 78. The arrows 92 indicate the air flow, which from the air chamber 67 moves past the slide segment 82, displaced out of the slide conduit 80 into the interior of the injection body 57, to reach the gap 76, where in the nonblocked left-hand guide conduit 78, it meets the fuel stream 14 injected through the at least one nonblocked injection segment and is injected with it in a preparing way.

Figure 7:
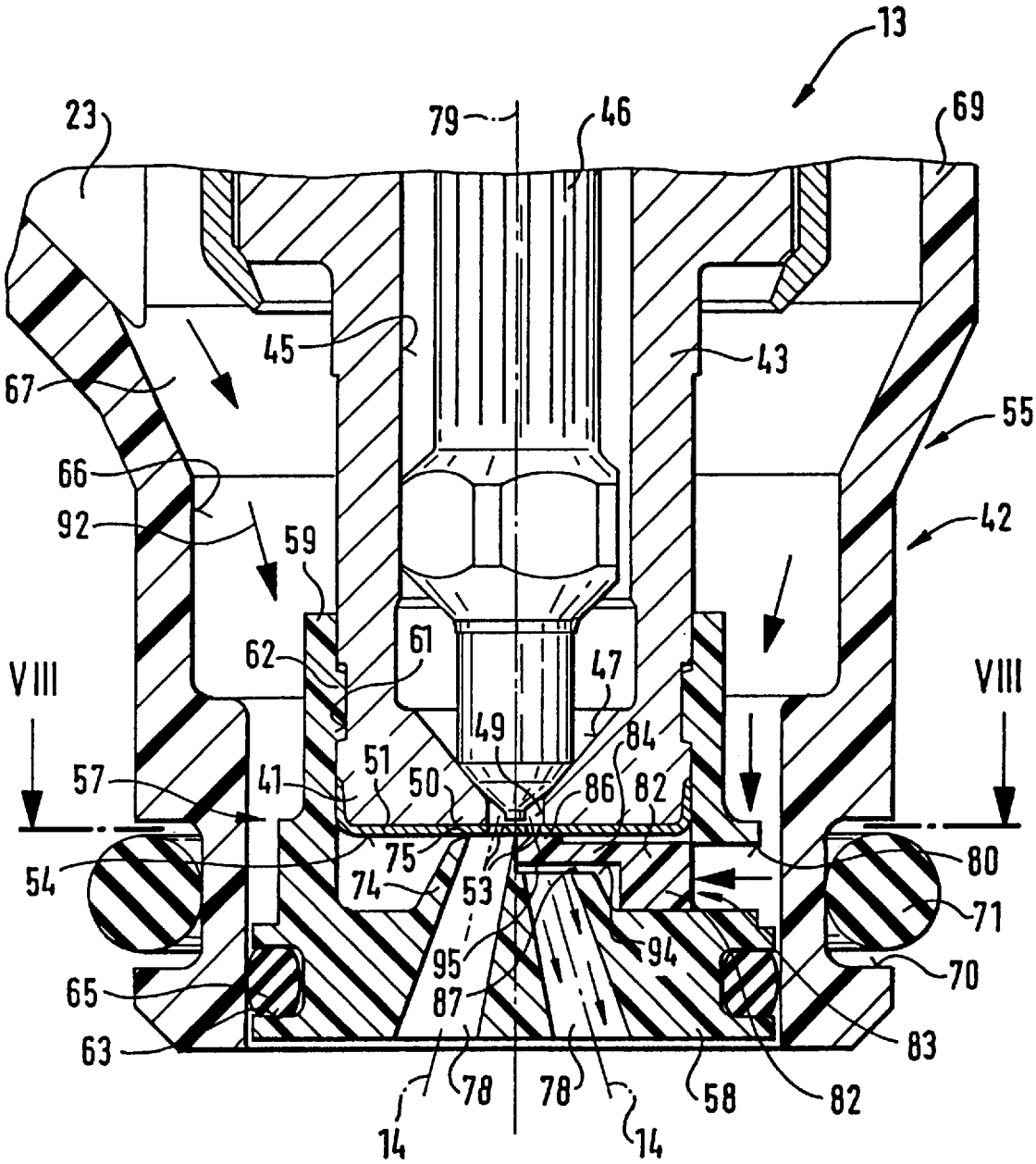
FIG. 7 shows a second exemplary embodiment of a fuel injection valve provided according to the invention with a blocking element, the blocking element being located in the blocking position.
Figure 8:
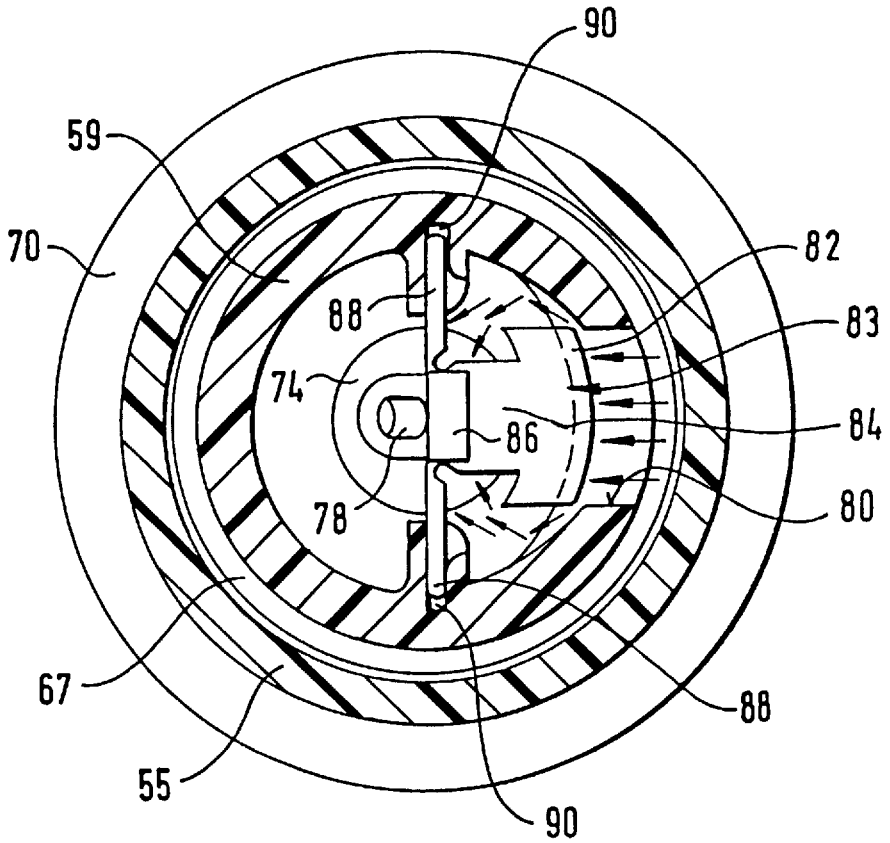
FIG. 8 is a section taken along the line VIII—VIII of FIG. 7.

FIGS. 7 and 8, like FIGS. 5 and 6, show a fuel injection valve with the front attachment 42 described and with a blocking element 83 located in the blocking position; however, in the embodiment of FIGS. 7 and 8 the dome 74 is so high that it rests on the lower end face 54 of the injection port disk 51 outside the dome groove 87, while between the lower face 94 of the land segment 84 and the dome groove 87 an axial groove gap 95 is formed, by way of which the air flowing from the air chamber 67 into the interior of the injection body 57, in the blocking position of the blocking element 83, can flow into the guide conduit 78 associated with the blocked injection port 53. Such an embodiment is expedient whenever the injected fuel stream is intended to be a "hard" cord-shaped stream (pencil stream), or in other words with a very small stream cone angle.

The foregoing relates to preferred exemplary embodiments of the invention, it being understood that other variants and embodiments thereof are possible within the spirit and scope of the invention, the latter being defined by the appended claims.

We claim:

1. A fuel injection valve for injecting fuel into an internal combustion engine, in which at least two separate fuel streams are aimed into inlet conduits or in a direction of inlet openings, said inlet openings being controlled by inlet valves of different inlet conduits or inlet openings of at least one cylinder, a blocking element (83) is provided, which as a function of operating conditions of the engine (1) is movable into a position in which the blocking element interrupts at least one of the fuel streams (14), an injection port disk (51) with at least two injection ports (53) for forming the at least two fuel streams (14) is provided on an injection end (41) of the fuel injection valve (13), and guide conduits (78), through each of which one of the fuel streams (14) can be injected, penetrate a front attachment (42) downstream of the injection sort disk (51), the blocking element (83) is movably supported in the front attachment (42) disposed on the injection end (41) of the fuel injection valve (13) and the blocking element (83) has a sealing segment (86), which rests on the injection port disk (51).

2. The fuel injection valve in accordance with claim 1, in which the blocking element (83) is displaceable transversely to a longitudinal valve axis (79).

3. The fuel injection valve in accordance with claim 2, in which the displacement of the blocking element (83) is effected in a direction of an interruption of at least one fuel stream (14) by means of a fluid or electromagnetically, counter to a restoring force (88).

4. The fuel injection valve in accordance with claim 3, in which spring arms (83) which are formed onto the blocking element (83) serve as the restoring force.

5. The fuel injection valve in accordance with claim 4, in which the spring arms (88) protrude into guide grooves (90) of the front attachment (42).

6. The fuel injection valve in accordance with claim 1, in which the blocking element (83) has a slide segment (82) that is guided in the front attachment (42).

7. The fuel injection valve in accordance with claim 1, in which an air line (23) leads from the intake tube (17) of the engine (1) upstream of a throttle valve (18) to the front attachment (42), and the blocking element (83) is movable by air.

8. The fuel injection valve in accordance with claim 7, in which the air that moves the blocking element (83) into the position that interrupts at least one fuel stream (14) is conducted in the front attachment (42) in such a way that said air meets that at least one uninterrupted fuel stream (14).

9. The fuel injection valve in accordance with claim 7, in which the air line (23) is closable partway or entirely by a control valve (21).

10. The fuel injection valve in accordance with claim 7, in which by means of the blocking element (83), simultaneously at least one injection port (53) of the injection port disk (51) and one guide conduit (78) in the front attachment (42) can be blocked.

11. The fuel injection valve in accordance with claim 7, in which by means of the blocking element (83), at least one injection port (53) of the injection port disk (51) is blocked, then the air can be conducted only via the guide conduit (78) associated with this port.

12. A fuel injection valve for injecting fuel into an internal combustion engine, in which at least two separate fuel streams are aimed into inlet conduits or in a direction of inlet openings, said inlet openings being controlled by inlet valves of different inlet conduits or inlet openings of at least one cylinder, a blocking element (83), said blocking element (83) as a function of operating conditions of the engine (1) is movable into a position in which the blocking valve interrupts at least one of the fuel streams (14), an air line (23) that is closable by a control valve (21) leads from the intake tube (17) of the engine (1) upstream of a throttle valve (18) to a front attachment (42) and the blocking element (83) is movable by air, the air that moves the blocking element (83) into the position that interrupts at least one fuel stream (14) is conducted in the front attachment (42) in such a way that the blocking element meets that at least one uninterrupted fuel stream (14) and an idling regulation valve is used as the control valve (21), which for regulating the idling of the engine (1) regulates an air bypass (19) that bypasses the throttle valve (18).

* * * * *